US006595357B2

(12) United States Patent
Sutter et al.

(10) Patent No.: US 6,595,357 B2
(45) Date of Patent: Jul. 22, 2003

(54) GOLF CLUB ORGANIZING ASSEMBLY HAVING COMPARTMENT-FORMING DIVIDERS OF DIFFERENT COLORS

(75) Inventors: James L. Sutter, Evergreen, CO (US); James W. Thomas, Evergreen, CO (US)

(73) Assignee: Great Divider Golf, Inc., Golden, CO (US)

( * ) Notice: Subject to any disclaimer, the term of this patent is extended or adjusted under 35 U.S.C. 154(b) by 60 days.

(21) Appl. No.: 09/819,912

(22) Filed: Mar. 28, 2001

(65) Prior Publication Data

US 2001/0025802 A1 Oct. 4, 2001

Related U.S. Application Data

(60) Provisional application No. 60/194,264, filed on Mar. 31, 2000.

(51) Int. Cl.[7] ..... A61J 55/00
(52) U.S. Cl. ..... 206/315.6; 206/315.3
(58) Field of Search ..... 206/315.3, 315.6; 211/70.2

(56) References Cited

U.S. PATENT DOCUMENTS

| | | | | | |
|---|---|---|---|---|---|
| 5,133,395 | A | * | 7/1992 | Moore | 150/160 |
| 5,671,843 | A | | 9/1997 | Sutter | 206/315.6 |
| 5,785,173 | A | * | 7/1998 | Kim | 206/315.6 |
| 5,816,398 | A | * | 10/1998 | Wang | 206/315.6 |
| 5,971,147 | A | | 10/1999 | Sutter | 206/315.6 |
| 6,076,245 | A | | 6/2000 | Sutter | 29/428 |
| 6,102,202 | A | * | 8/2000 | Jones | 206/315.6 |
| 6,158,582 | A | * | 12/2000 | Chang-Lin | 206/316.6 |

* cited by examiner

*Primary Examiner*—Sue A. Weaver
(74) *Attorney, Agent, or Firm*—Flanagan & Flanagan; John R. Flanagan

(57) ABSTRACT

A golf club organizing assembly for a golf club carrying bag includes a plurality of dividers. Some of the dividers extend in intersecting transverse relationships with other of the dividers so as to form a plurality of compartments therebetween for receiving shafts of golf clubs placed in a carrying bag. Also, some dividers are of colors different from and contrasting with colors of other dividers so as to provide contrasting colors about the compartments which improve visibility of compartments to a golfer over a case where all of the dividers are of the same color.

12 Claims, 3 Drawing Sheets

GOLF CLUB ORGANIZING ASSEMBLY HAVING COMPARTMENT-FORMING DIVIDERS OF DIFFERENT COLORS

This patent application claims the benefit of U.S. provisional patent application No. 60/194,264 filed on Mar. 31, 2000.

BACKGROUND OF THE INVENTION

1. Field of the Invention

The present invention generally relates to arranging golf clubs in carrying bags and, more particularly, is concerned with a golf club organizing assembly having compartment-forming dividers provided in different contrasting colors which improve visibility of the compartments to the golfer so as to facilitate easier, quicker and more accurate insertion of golf clubs by the golfer into the compartments.

2. Description of the Prior Art

Golf clubs are often carried in a sleeve-like bag designed for that purpose. A basic golf club carrying bag has a tubular sidewall open at an upper end and closed at a lower end by a bottom end wall. An interior of the bag defines a cavity in which the golf clubs are stored vertically with their handgrip ends down so that heads of the clubs extend above the open upper end of the bag. The golf clubs are generally separated from one another by a plurality of dividers which cross one another and so as to form a plurality of pockets or compartments therebetween. Each compartment receives one or more golf clubs.

Golf clubs generally differ from one another in terms of lengths of their shafts, shapes and sizes of their heads, and angles at which their golf ball striking surfaces extend relative to a horizontal plane. Golfers select one of the clubs to use for any given stroke depending on the particular placement of the ball whether in the rough or on the tee, fairway or green and the distance of the ball from the hole. As a result, many golfers prefer to maintain their clubs in their bag in some organized fashion so that they can quickly locate and replace the one club they have selected to use for the particular stroke at hand.

A problem exists, however, in that the dividers are typically the same color and so it is often difficult to clearly distinguish between the compartments so as to see the one compartment in the golf bag where a golf club is intended to be replaced after use. As a result, the golf club may be unintentionally and incorrectly inserted by the golfer into an adjacent compartment so as to either make abrasive scratch-producing contact with the club occupying that compartment or at least create a breakdown in the desired organization of the clubs so as to cause the golfer to spend more time searching for the desired club the next time it is used.

Consequently, a need exists for an innovation that will overcome this problem without introducing any new problems in its place.

SUMMARY OF THE INVENTION

The present invention overcomes the aforementioned problem and satisfies the aforementioned need by providing a golf club organizing assembly having compartment-forming dividers of different contrasting colors which improve visibility of the compartments to the golfer so as to facilitate easier, quicker and more accurate insertion of golf clubs by the golfer into the compartments. With the dividers being of different contrasting colors, such as for example a two-tone black/grey combination, the golf club organizing assembly provides better visibility of the separate compartments to the golfer when replacing clubs into their desired compartments in the golf bag.

Accordingly, the present invention is directed to a golf club organizing assembly for a golf club carrying bag. The organizing assembly comprises: (a) a plurality of dividers, some of the dividers extending in intersecting transverse relationships with other of the dividers so as to form a plurality of compartments therebetween for receiving shafts of golf clubs placed in a carrying bag; (b) each of the dividers having a color, some of the dividers being of colors different from and contrasting with colors of other dividers so as to provide contrasting colors about the compartments which enhances visibility of the compartments to a golfer. The colors of some of the dividers is a light color, such as grey, and the colors of other of the dividers is a dark color, such a black. More particularly, the dividers include divider members having covering strips thereon. The covering strips are of the respective colors.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which.

DETAILED DESCRIPTION OF THE INVENTION

Figure 1:
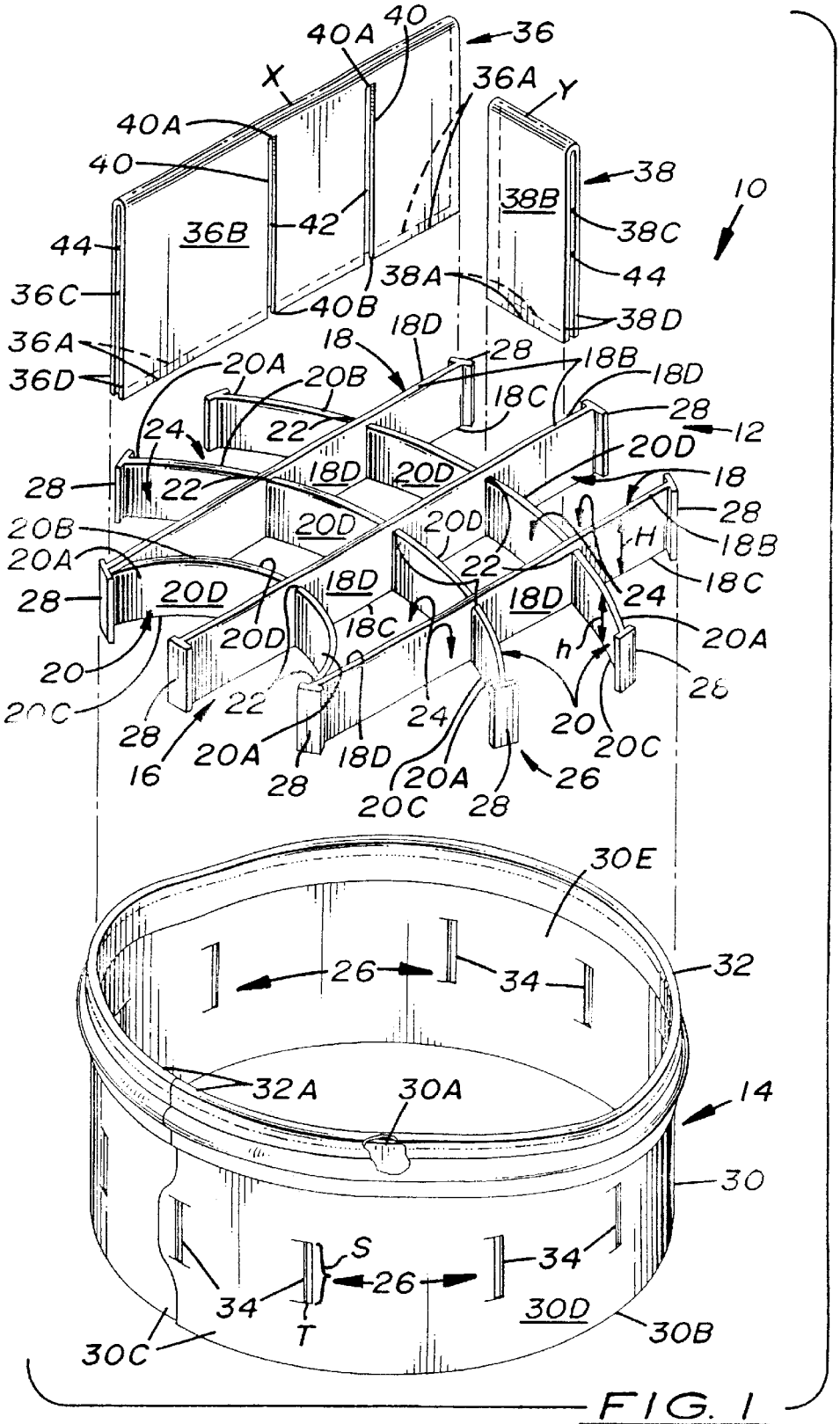
FIG. 1 (PRIOR ART)
FIG. 1 is an exploded perspective view of an exemplary embodiment of a prior art golf club organizing assembly which can employ the features of the present invention.
Figure 2:
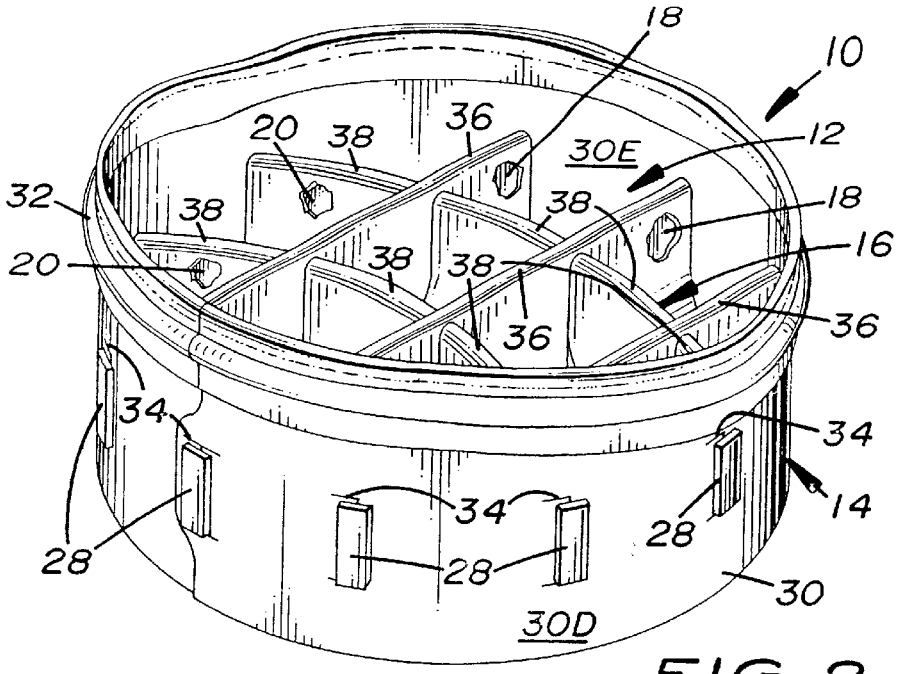
FIG. 2 (PRIOR ART)
FIG. 2 is an assembled perspective view of the prior art golf club organizing assembly of FIG. 1.
Figure 3:
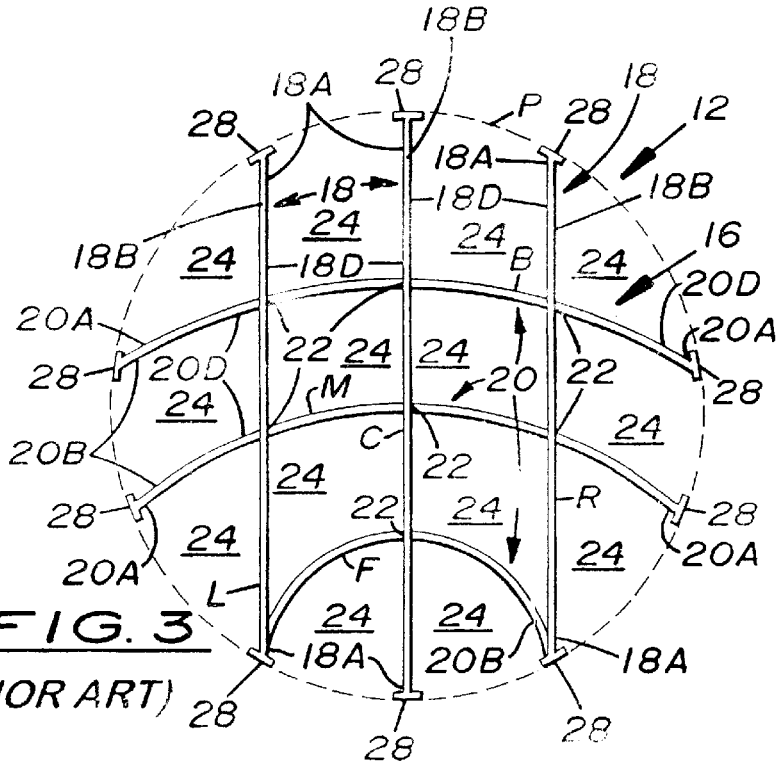
FIG. 3 (PRIOR ART)
FIG. 3 is a top plan view of the prior art golf club organizer structure of the organizing assembly of FIG. 1.

Referring to the drawings and particularly to FIGS. 1 to 3, there is illustrated an exemplary embodiment of a prior art golf club organizing assembly, generally designated 10, to which the present invention is applied. It is readily understood that the present invention can equally be applied to other embodiments of golf club organizing assemblies found in the prior art and thus is not limited in its application just to the organizing assembly 10 illustrated in FIGS. 1 to 3. The particular organizing assembly 10 shown and described herein is the subject of U.S. Pat. No. 5,971,147 which is assigned to the assignee of the present invention. The organizing assembly 10 basically includes a molded one-piece golf club organizer structure 12 which constitutes the interior component of the organizing assembly 10 and a top collar 14 which constitutes an exterior component thereof. The organizer structure 12 and top collar 14 provide the patented organizing assembly 10 in a two-piece construction which defines an array of locations in an open upper end of a golf bag for receiving golf clubs in a logical arrangement.

The molded one-piece organizer structure 12 of the patented organizing assembly 10 includes a molded one-piece framework 16 having a plurality of dividers, such as pluralities of first and second divider members 18, 20. Each of the first and second divider members 18, 20 has opposite ends 18A, 20A, spaced upper and lower longitudinal edges 18B, 18C and 20B, 20C extending between the opposite ends 18A, 20A, and oppositely facing surfaces 18D, 20D extending between the upper and lower longitudinal edges 18B, 18C and 20B, 20C. The first divider members 18 extend in intersecting relationships with the second divider members 20 so as to form a plurality of junctures 22 therewith and a plurality of compartments 24 therebetween for receiving shafts of golf clubs (not shown) placed in a carrying bag (not shown). The patented organizing assembly 10 also include means, generally designated 26, for securing the framework 16 to the top collar 14 of the carrying bag.

In the patented organizing assembly 10, each of the first divider members 18 of the framework 16 has a substantially straight configuration and extends in a first direction whereas each of the second divider members 20 of the framework 16 has a substantially curved configuration and extends in a second direction transversely to the first direction of each of the first dividers 18. The framework 16 preferably includes three first divider members 18 and three second divider members 20 and forms fourteen compartments 24. Each of the first divider members 18 of the framework 16 has a height H which is greater than the height h of each of the second divider members 20 of the framework 16 such that the upper longitudinal edges 18B of the first divider members 18 are disposed above the upper longitudinal edges 20B of the second divider members 20. However, the lower longitudinal edges 18C, 20C of the first and second divider members 18, 20 are substantially disposed in a common plane or are flush with one another. The upper longitudinal edges 18B of the first divider members 18 thus extend above the upper longitudinal edges 20B of the second divider members 20. The framework 16 is preferably fabricated from a suitable plastic as one piece employing conventional injection molding techniques. The first and second divider member 18, 20 of the framework 16, although integrally connected to one another and relatively stiff overall so as to retain their desired shape, are somewhat bendable and flexible so as to facilitate their being assembled with the top collar 14 of the golf bag.

Also, in the patented organizing assembly 10, the first divider members 18 of the framework 16 can be distinguished from one another by identifying them individually as right R, center C and left L. The right R and left L ones of the first divider members 18 have substantially the same length. The center one C of the first divider members 18 has a length slightly greater than the lengths of the right and left ones R, L of the first divider members 18. The second divider members 20 of the framework 16 can be distinguished from one another by identifying them individually as front F, middle M and back B. The front one F of the second divider members 20 has a substantially greater degree of curvature than do either of the middle and back ones M, B of the second divider members 20. Of the middle and back ones M, B of the second divider members 20, the middle one M has a slightly greater degree of curvature. The front one F of the second divider members 20 merges at its opposite ends 20A with the opposite ends 18A of the right and left ones R, L of the first divider members 18.

The securing means 26 of the patented organizing assembly 10 includes a plurality of connector tabs 28 integrally fixed on the opposite ends 18A, 20A of at least more than half and, preferably, all of the first and second divider members 18, 20 of the framework 16. The connector tabs 28 are provided for securing the framework 16 at the opposite ends 18A, 20A of the first and second divider members 18, 20 to the top collar 14 of the golf club carrying bag. Each connector tab 28 extends in opposite directions from the opposite end 18A, 20A of those of the first and second divider members 18, 20 having the connector tabs 28 to provide a generally T-shaped configuration therewith such that the connector tabs 28 together lie along an annular path P conforming to a shape of the top collar 14 of the carrying bag to which the framework 16 is secured by the connector tabs 28. Each connector tab 28 on the opposite ends 18A of the center one C of the first divider members 18 is disposed in substantially perpendicular relation to the oppositely facing surfaces 18D thereof and extends in opposite directions therefrom through substantially the same distance outwardly therefrom. Each connector tab 28 on the right and left ones R, L of the first divider members 18 is disposed in an angled relation to the oppositely facing surfaces 18D thereof and extends in opposite directions therefrom but farther toward the center one C of the first divider members 18 than away therefrom. The connector tabs 28 on the front one F of the second divider members 20 are the same as the connector tabs 28 on the adjacent ends 18A of the right and left ones R, L of the first divider members 18. Each connector tab 28 on the middle and back ones M, B of the second divider members 20 is disposed in an angled relation to the oppositely facing surfaces 20D thereof and extends in opposite directions therefrom but farther toward the front one F of the second divider members 18 than away therefrom.

The top collar 14 of the patented organizing assembly 10 includes an annular body 30 encircling the framework 16. The annular body 30 has a height, although varying somewhat along the circumference of the annular body 30, which is substantially greater than the heights H, h of the first and second divider members 18, 20 of the framework 16. The annular body 30 has opposite top and bottom edges 30A, 30B, opposite ends 30C and opposite outer and inner surfaces 30D, 30E. The variation in height of the annular body 30 occurs gradually over its circumference such that its height nearer to the front one F of the second divider members 20 is less than its height nearer to the back one B of the second divider members 20. The annular body 30 also has a protective covering 32 which is disposed over the top edge 30A and onto the outer and inner surfaces 30D, 30E and extends the full circumference (or longitudinal length) of the annular body 30. The protective covering 32 may cover more of the outer surface 30D than the inner surface 30E thereof. The protective covering 32 is sewn to each of the outer and inner surfaces 30D, 30E adjacent top edge 30A. The protective covering 32 may have a decorative configuration on the outer surface 30D, such as one which resembles a rounded ridge. The annular body 30 is preferably comprised of a material which is more flexible than that which comprises the first and second divider members 18, 20, though may be made of any other suitable material.

The securing means 26 further includes a plurality of apertures 34 defined therethrough in spaced apart relation to one another along the circumference (or longitudinal length) of the annular body 30 of the top collar 14. Each aperture 34 has substantially C-shaped or I-shaped configuration or any other suitable shape and has a height S extending along the height of the annular body 30 which is greater than a width T of the aperture 34. Each aperture 34 receives a respective one of the connector tabs 28 integrally fixed on the opposite ends 18A, 20A of the first and second divider members 18, 20 of the framework 16 for securing the framework 16 to the top collar 14 such that the annular body 30 is retained in a wrapped relation about the framework 16. The annular body 30 has eleven of the apertures 34 which is one more than the number of connector tabs 28. The apertures 34 are positioned in spaced relation to one another along the circumference (or longitudinal length) of the annular body 30 such that each of the apertures 34 may receive one of the connector tabs 28. Each aperture 34 is spaced from the top and bottom edges 30A, 30B of the annular body 30. The apertures 34 receiving the rear connector tabs 28 of the first divider members 18 are spaced approximately halfway between the top and bottom edges 30A, 30B of the annular body 30. The apertures 34 receiving the other connector tabs 28 of the first and second divider members 18, 20 are spaced closer to the bottom edge 30B than to the top edge 30A of the annular body 30. The opposite ends 30C of the annular body 30 are overlapped to align the apertures 34 therein with one another so that both receive the front connector tab 28 of the center one C of the first divider members 18 therethrough. The opposite ends 32A of the protective cover 32 are also overlapped and riveted together.

Further, in the patented organizing assembly 10, the dividers of the organizer structure 12 may also include a plurality of first and second covering strips 36, 38 respectively applied over the first and second divider members 18, 20 of the framework 16 and along the oppositely facing surfaces 18D, 20D of the first and second divider members 18, 20 so as to protect the shafts of the golf clubs and to provide an attractive appearance to the assembly 10. Each of the first covering strips 36 is folded along an imaginary longitudinal fold line X over the upper longitudinal edge 18B of one of the first divider members 18 and is continuous between the opposite ends 18A of the first divider member 18 along the upper longitudinal edge 18B so as to completely overlie and cover the higher upper longitudinal edge 18B of the first divider member 18. Each of the first covering strips 36 has a pair of opposite longitudinal edges 36A and opposite outer and inner surfaces 36B, 36B. Also, each of the first covering strips 36 has a pair of aligned slits 40 respectively formed in the first covering strip 36 transversely to the imaginary longitudinal fold line X and at the junctures 22 of the first divider member 18 with the second divider members 20 to provide slots 42 in the first covering strip 36 for accommodating the second divider members 20 of the framework 16. The slits 40 of each pair thereof has inner ends 40A spaced apart in opposite directions from the imaginary longitudinal fold line X of the first covering strip 36 and extend to outer ends 40B located at the opposite longitudinal edges 36A of the first covering strip 36 such that the slots 42 are open at the opposite longitudinal edges 36A thereof.

Each of the second covering strips 38 is folded over the upper longitudinal edge 20B of one of the second divider members 20 of the framework 16 and extends between the junctures 22 with adjacent ones of the first divider members 18 or between an opposite end 20A of one of the second divider members 20 and the juncture 22 with an adjacent one of the first divider member 18. In such manner, the first and second covering strips 36, 38 completely cover the first and second divider members 18, 20 of the framework 16 and there is a substantially greater number of second covering strips 38 than first covering strips 36. Each of the first and second covering strips 36, 38 is preferably a substantially flexible sheet of material, and has an adhesive coating 44 applied on the inner surface 36C, 38C of the respective covering strip 36, 38. The adhesive coating 44 secures the respective covering strip 36, 38 to the corresponding one of the oppositely facing surfaces 18D, 20D of the first and second divider members 18, 20 of the framework 16 and to itself at lower portions 36D, 38D of the covering strips 36, 38 extending below the divider members 18, 20 of the organizer structure 12. Each of the first covering strips 36 has a longitudinal length substantially greater than a folded height. Each of the second covering strips 38 has a folded height greater than a longitudinal length. The organizer structure 12 particularly includes three first covering strips 36 and ten second covering strips 38, though may have any other suitable number of either the first or second covering strips 36, 38, depending upon the number of divider members 18, 20. The first and second divider members 18, 20 of the framework 16 must have the aforementioned different heights for the first and second covering strips 36, 38 to cover all surfaces of the first and second divider members 18, 20 of the framework 16. Each first and second covering strip 36, 38 is comprised of a substantially neoprene material, though may be made of any other suitable material. Once the covering strips 36, 38 are applied, their outer surfaces 36B, 38B are exposed to the golf clubs.

Figure 4:
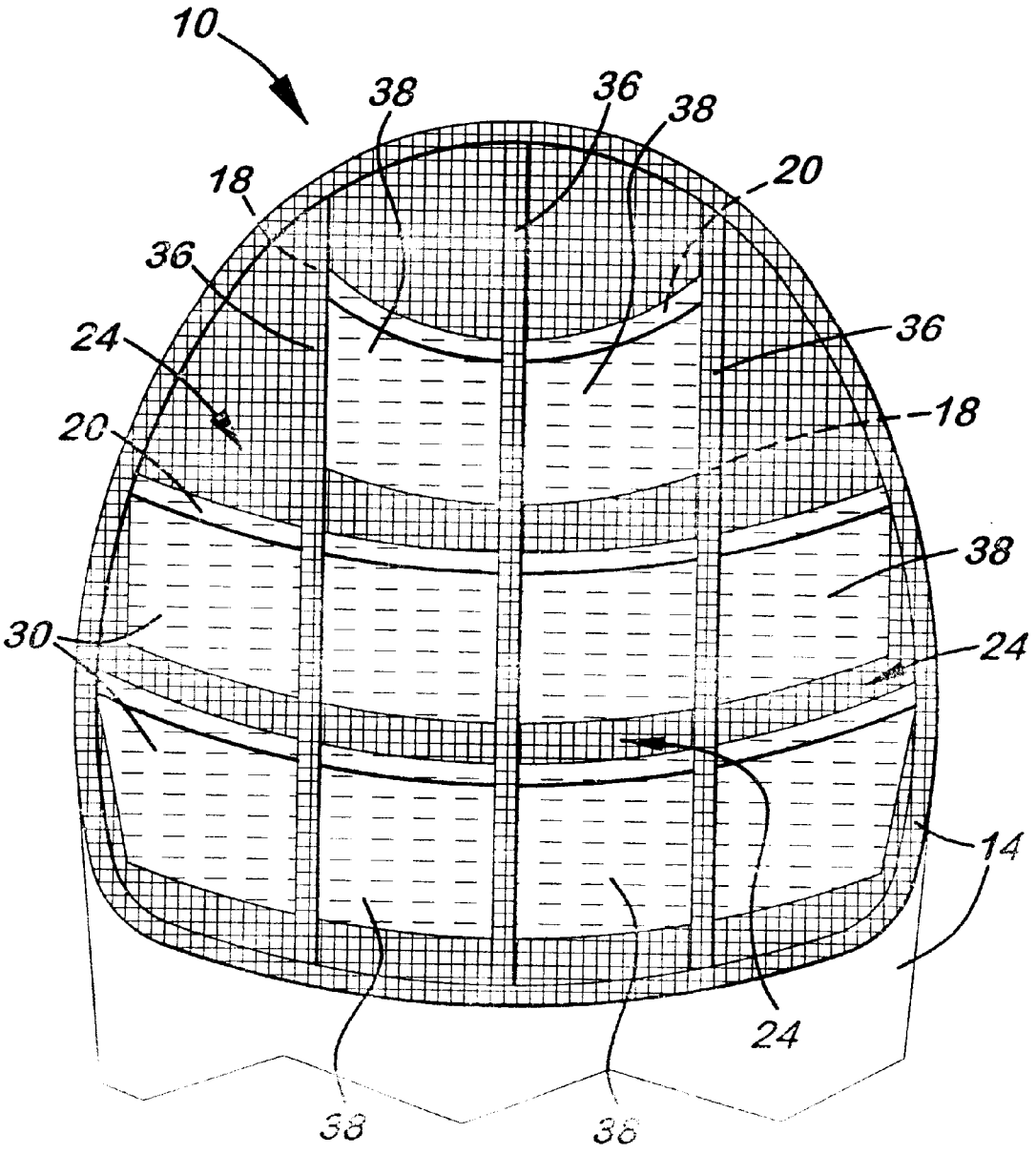
FIG. 4 is a top perspective view of the organizing assembly of FIG. 1 now shown incorporating dividers with different contrasting colors in accordance with the present invention.

In accordance with the present invention, as seen in FIG. 4 the first and second covering strips 36, 38 may be of different contrasting colors. Each of the first covering strips 36 may have a portion thereof which is one color or each of the first covering strips 36 may be entirely the one color. The one color may be a dark color, such as black, though need not be so limited. Each of the second covering strips 38 may have a portion thereof which is another color or each of the second covering strips 38 may be entirely the other color. The other color may be a light color, such as grey or white, though need not be so limited. The combination of contrasting colors (grey or white and black) of the second and first covering strips 38, 36, as being symbolically represented in FIG. 4, surrounding each compartment 24 facilitates the quick, easy and accurate return of golf clubs back into their compartments 24 by improving the visibility of, and thus the ability of the user to distinguish between, the compartments 24 surrounded by the first and second covering strips 36, 38 on the first and second divider members 18, 20 of the framework 16. The inside of the top collar 14 is preferably covered with the same material and of the same color as the first covering strips 36.

In an embodiment where the dividers of the organizer structure 12 does not include the first and second covering strips 36, 38, the first and second divider members 18, 20 of the framework 16 can be of the different contrasting colors. Each of the first divider members 18 may have a portion thereof which is one color or each of the first divider members 18 may be entirely the one color. The one color may be a dark color, such as black, though need not be so limited. Thus, the color of the first divider member 18 can be the same as the color of the first covering strip 36 described above. Each of the second divider members 20 may have a portion thereof which is another color or each of the second divider members 20 may be entirely the other color. The other color may be a light color, such as white or grey, though need not be so limited. Thus, the color of the second divider members 20 can be the same as the color of the second covering strip 38 described above. The combination of contrasting colors of the first and second divider members 18, 20 surrounding each of the compartments 24 facilitates the return of golf clubs back into their compartments 24 by improving the visibility of, and thus the ability of the user to distinguish between, the compartments 24 surrounded by the first and second divider members 18, 20. Therefore, either the first and second divider members 18, 20 of the framework 16 or the first and second covering strips 36, 38 or both provide the combinations of contrasting colors, such as black and white or grey, surrounding the compartments 24 to provide improved visibility for a user when replacing clubs in a golf bag.

It is thought that the present invention and its advantages will be understood from the foregoing description and it will be apparent that various changes may be made thereto without departing from the spirit and scope of the invention or sacrificing all of its material advantages, the form hereinbefore described being merely preferred or exemplary embodiment thereof.

We claim:

1. A golf club organizing assembly for a golf club carrying bag, said assembly comprising:

(a) first and second pluralities of dividers, said dividers of said first plurality thereof extending in first directions and intersecting transverse relationships with said dividers of said second plurality thereof which extend in second directions generally transverse to said first directions so as to form a plurality of compartments therebetween for receiving shafts of golf clubs placed in a carrying bag;

(b) each of said dividers of said first plurality thereof having a first color and each of said dividers of said second plurality thereof having a second color different from and contrasting with said first color of said each of dividers of said first plurality thereof so as to provide a combination of contrasting colors surrounding each of said compartments which enhance visibility of said compartments to a golfer.

2. The assembly of claim 1 wherein said first color is black.

3. The assembly of claim 2 wherein said second color is grey.

4. The assembly of claim 1 wherein said second color of said dividers of said second plurality thereof is a light color and said first color of said dividers of said first plurality thereof is a dark color.

5. The assembly of claim 1 wherein said dividers of said first and second pluralities thereof include divider members having covering strips thereon, said covering strips being respectively of said first and second colors.

6. A golf club organizing assembly for a golf club carrying bag, said assembly comprising:

(a) a plurality of first dividers each having a first color;

(b) a plurality of second dividers each having a second color, said second dividers extending in intersecting transverse relationships with said first dividers so as to form a plurality of compartments therebetween for receiving shafts of golf clubs placed in a carrying bag, said second color of said second dividers being different from and contrasting with said first color of said first dividers so as to provide a combination of contrasting colors surrounding each of said compartments which enhance visibility of said compartments to a golfer; and (c) an annular collar encircling said first and second dividers and attached to opposite ends of said first and second dividers, said annular collar having one of said first and second colors.

7. The assembly of claim 6 wherein said first color is black.

8. The assembly of claim 7 wherein said second color is grey.

9. The assembly of claim 6 wherein said second color of said second dividers is a light color and said first color of said first dividers is a dark color.

10. The assembly of claim 6 wherein said first and second dividers respectively include divider members having covering strips thereon, said covering strips being respectively of said first and second colors.

11. A golf club organizing assembly for a golf club carrying bag, said assembly comprising:

(a) a plurality of dividers, some of said dividers extending in intersecting transverse relationships with other of said dividers so as to form a plurality of compartments therebetween for receiving shafts of golf clubs placed in a carrying bag;

(b) each of said dividers having a color, some of said dividers having colors different from and contrasting with said colors of other dividers so as to provide contrasting colors surrounding said compartments which enhance visibility of said compartments to a golfer, one of said colors being black, another of said colors being grey.

12. A golf club organizing assembly for a golf club carrying bag, said assembly comprising:

(a) a plurality of first dividers each having a color; and (b) a plurality of second dividers each having a color, at least some of said second dividers extending in intersecting transverse relationships with at least some of said first dividers so as to form a plurality of compartments therebetween for receiving shafts of golf clubs placed in a carrying bag;

(c) said colors of said some of said second dividers being different from and contrasting with said colors of said some of said first dividers so as to provide contrasting colors which enhance visibility of said compartments to a golfer, one of said colors being black, another of said colors being grey.

* * * * *